United States Patent [19]

Archer et al.

[11] 4,398,856

[45] Aug. 16, 1983

[54] HEAVY DUTY CLOSING MACHINE WITH CALENDAR HANGER FEED UNIT

[75] Inventors: Derek J. Archer, Weybridge; Leonard W. N. Jones, Camberley, both of England

[73] Assignee: James Burn Bindings Limited, Surrey, England

[21] Appl. No.: 300,497

[22] Filed: Sep. 9, 1981

[30] Foreign Application Priority Data

Sep. 11, 1980 [GB] United Kingdom ..... 8029337

[51] Int. Cl.[3] ..... B42B 5/10; B21F 35/02

[52] U.S. Cl. ..... 412/39; 140/102

[58] Field of Search ..... 412/1, 6, 9, 39; 140/92.3, 92.4, 92.7, 102, 103, 104, 105

[56] References Cited

U.S. PATENT DOCUMENTS 4,228,830 10/1980 Boyadjain ..... 412/39 X

FOREIGN PATENT DOCUMENTS 1209939 10/1970 United Kingdom .

1209940 10/1970 United Kingdom .

*Primary Examiner*—Paul A. Bell

*Attorney, Agent, or Firm*—Wood, Herron & Evans

[57] ABSTRACT

A closing machine for closing wire binding elements to bind bundles of sheets in which a press means or closing bar (1) is arranged to close onto an anvil (2) to close the binding elements (6, 7) around a bundle of sheets (10), in which a magazine (12) feeds hanger elements (16) to a translating means (15) which positions the hanger elements singly in a press position (9) between the press means (1) and anvil (2); the translating means (15) is preferably moved towards the press position by means of a camming member (44) connected to the press means.

5 Claims, 10 Drawing Figures

HEAVY DUTY CLOSING MACHINE WITH CALENDAR HANGER FEED UNIT

The present invention relates to a closing machine for closing wire binding elements to bind bundles of sheets. It is particularly applicable to those machines which use binding elements which are each formed from a length of metal wire bent to form a series of curved hairpin-shaped prongs on which sheets are impaled and which are brought to ring shape by pressing their closed ends or "points" into the vicinity of their open ends or "roots". Such binding elements will be referred to herein as "WireO" (Registered Trade Mark) binding elements.

When binding bundles of sheets to form calendars it is usual to feed by hand two lengths of Wire-O elements and a hanger into the calendar and then close the elements around the hanger and calendar and place the calendar into a closing machine for the closing operation. The hanger normally consisted of a straight length of wire with a central 'U' shaped or semicircular curved portion intended for receiving a wall hook for hanging up the calendar.

During the hand feeding operation there was also the danger of hangers falling out of the Wire-O elements before the closing operation was completed.

According to the invention there is provided a closing machine for closing wire bending elements comprising a press means and anvil for closing wire binding elements around a bundle of sheets, a magazine for storing hanger elements, and translating means for translating the hanger elements singly from the magazine to a press position between the press means and anvil.

Preferably the translating means is provided with a magnetised part so that the hanger element translated to the position between the press means and anvil is retained in the press position during the closing operation.

In the preferred embodiment the magnetised part has an at least part curvilinear shape to conform with a central shaped portion of the hanger element, the magnetised part being provided on a hanger pusher plate. The hanger pusher plate is moved in a generally horizontal plane into the press position by means of a camming member connected to the press means so that as the press descends on the Wire-O binding elements a hanger element is pushed from the bottom of the magazine into the press position and enters a thumb hole gap in the bundle of sheets between the binding elements. On completion of the closing operation the hanger element is held in the thumb hole gap by the binding elements.

Figure 1:
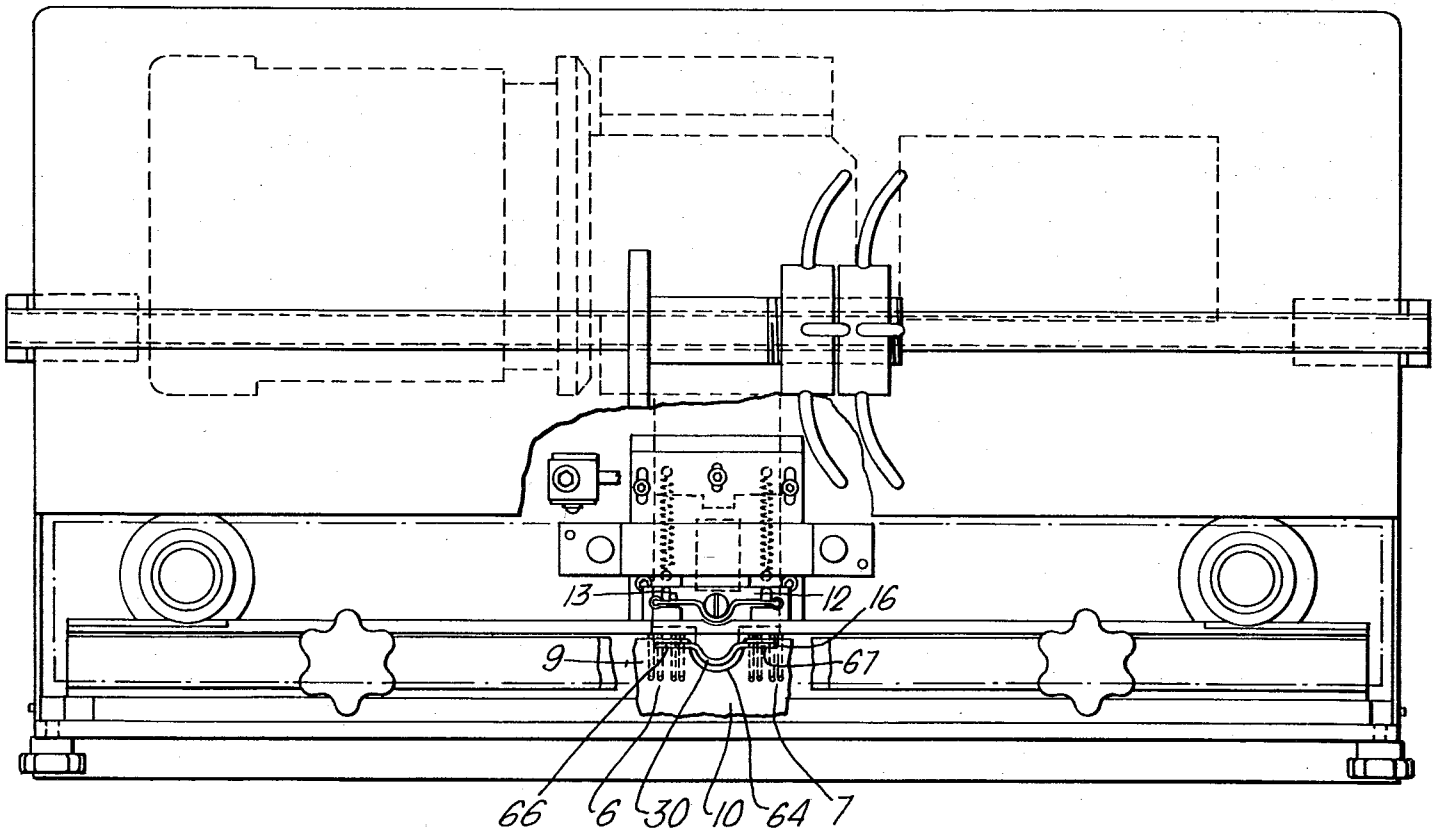
Figure 2:
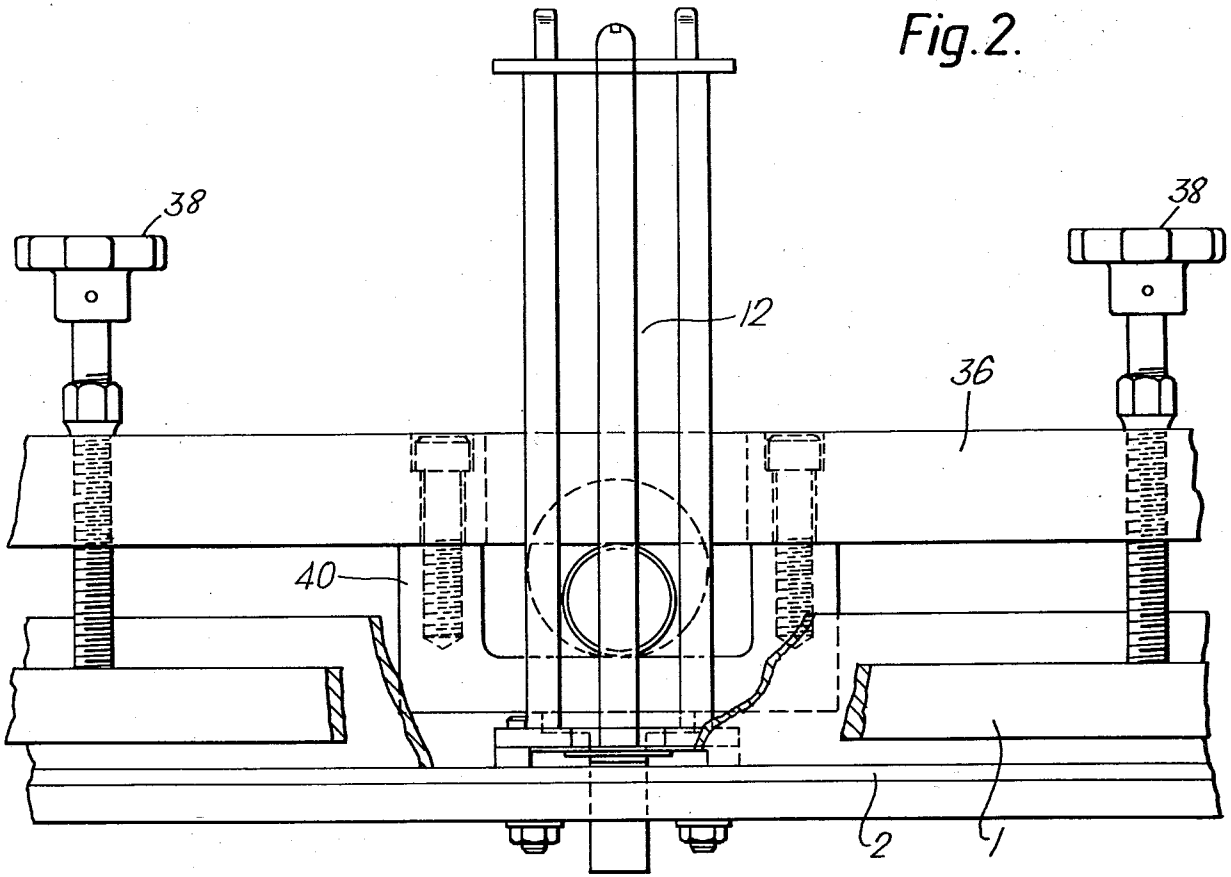
Figure 3:
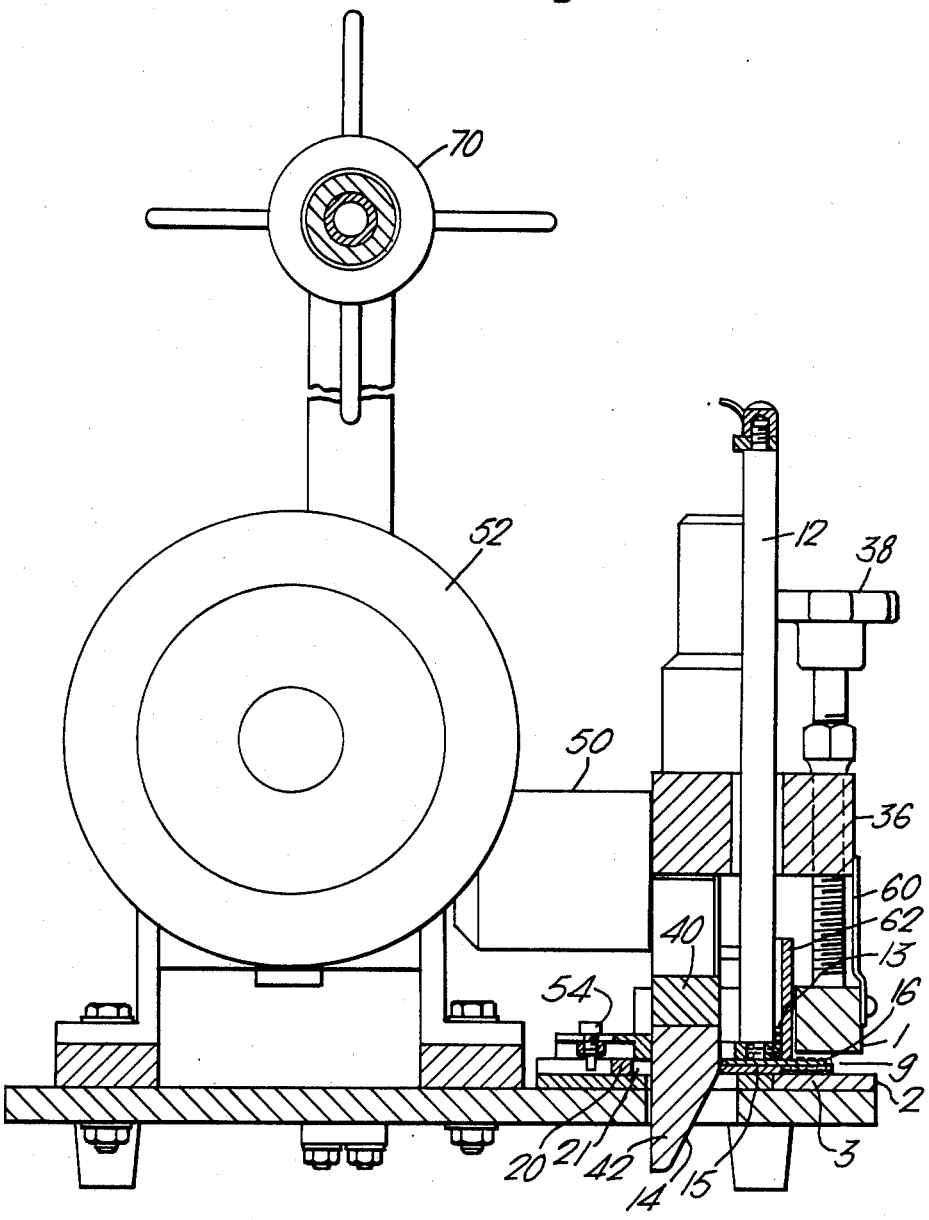
Figure 5:
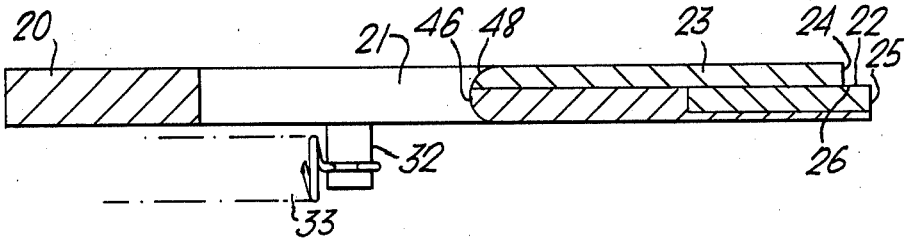
Figure 4:
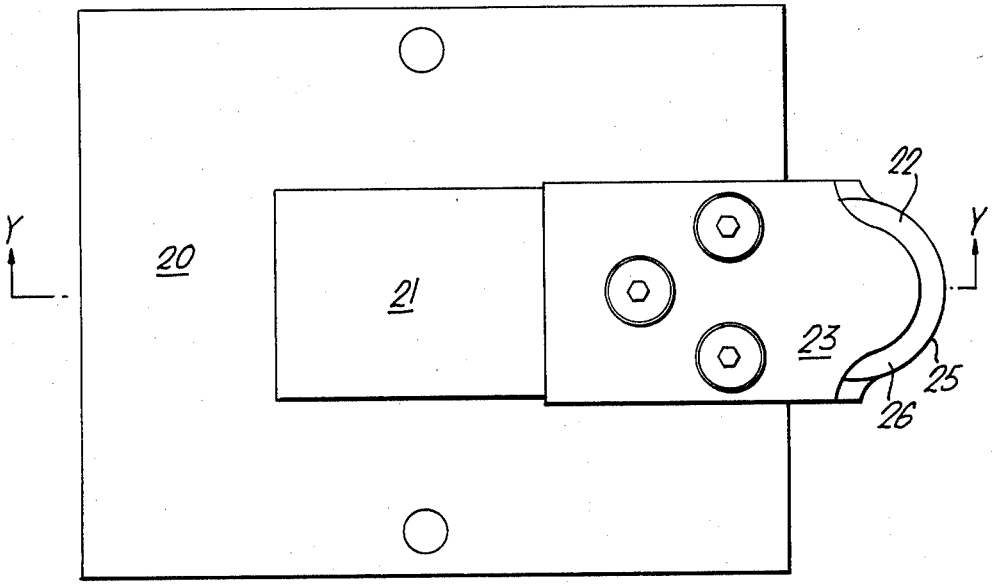
Figure 6:
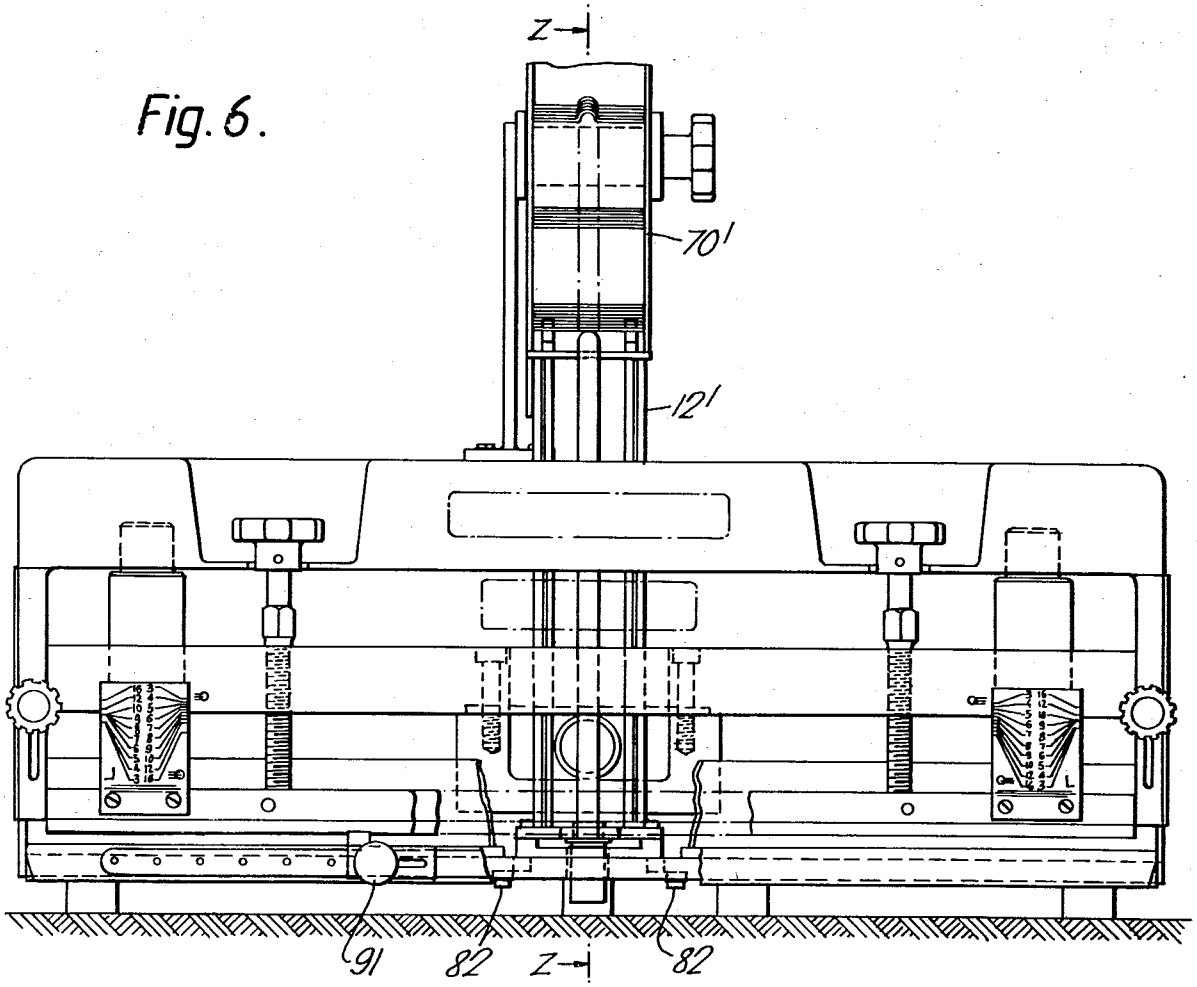
Figure 7:
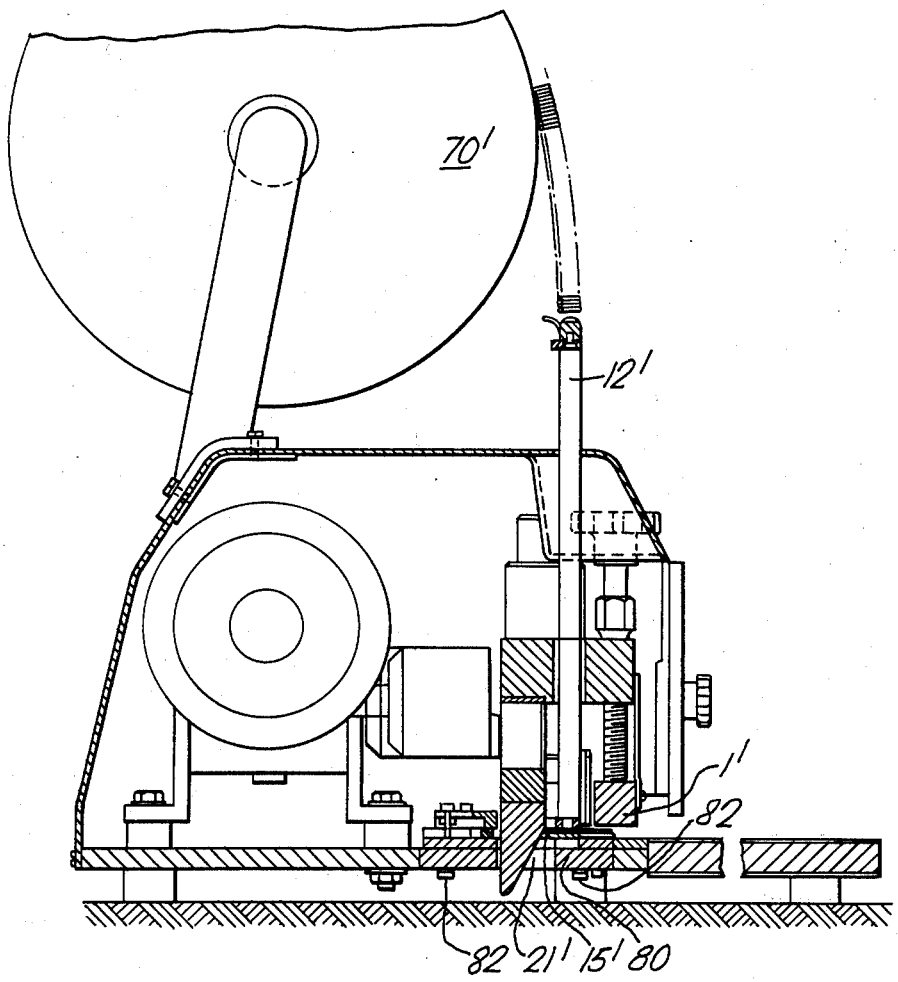
Figure 8:
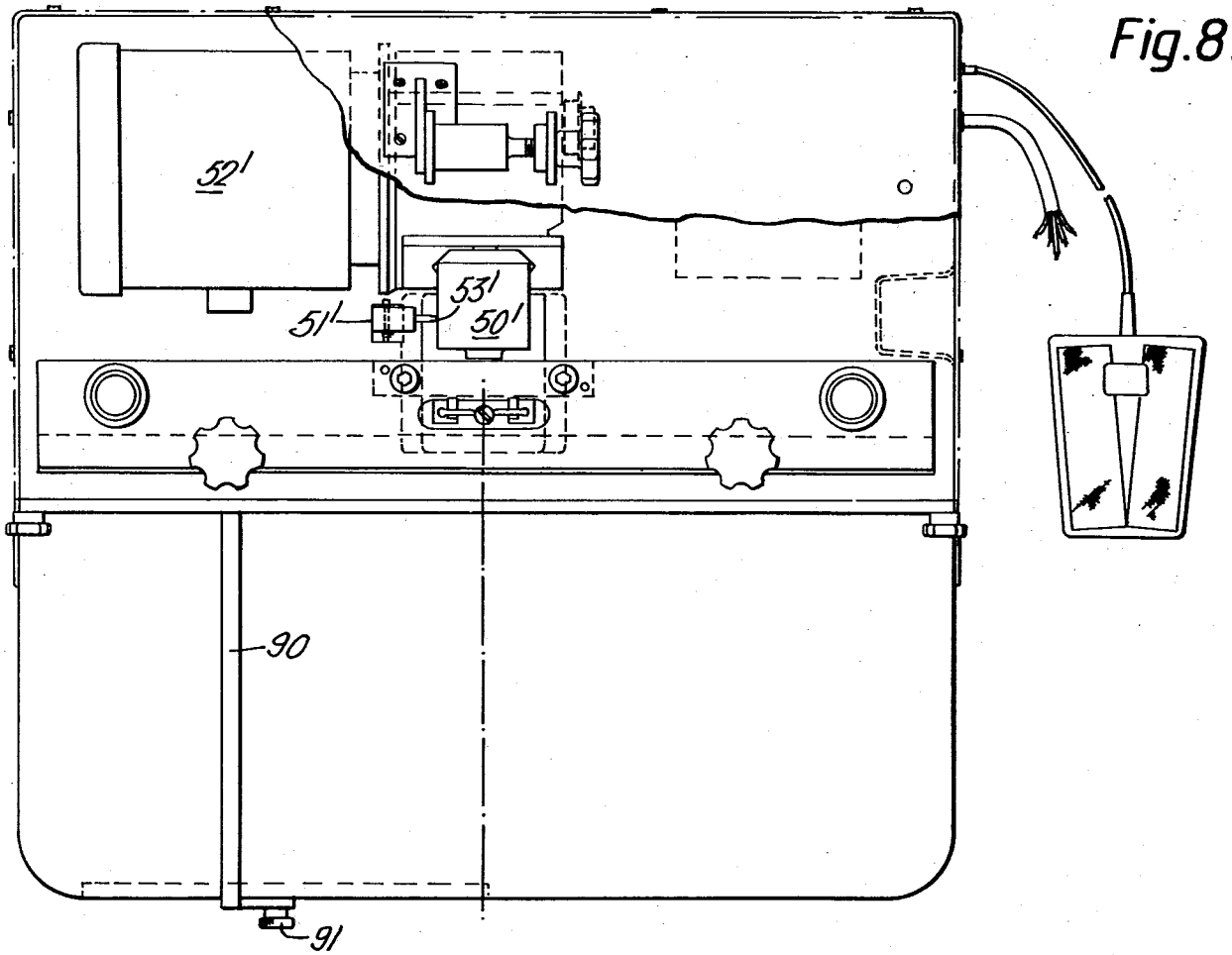
Figure 10:
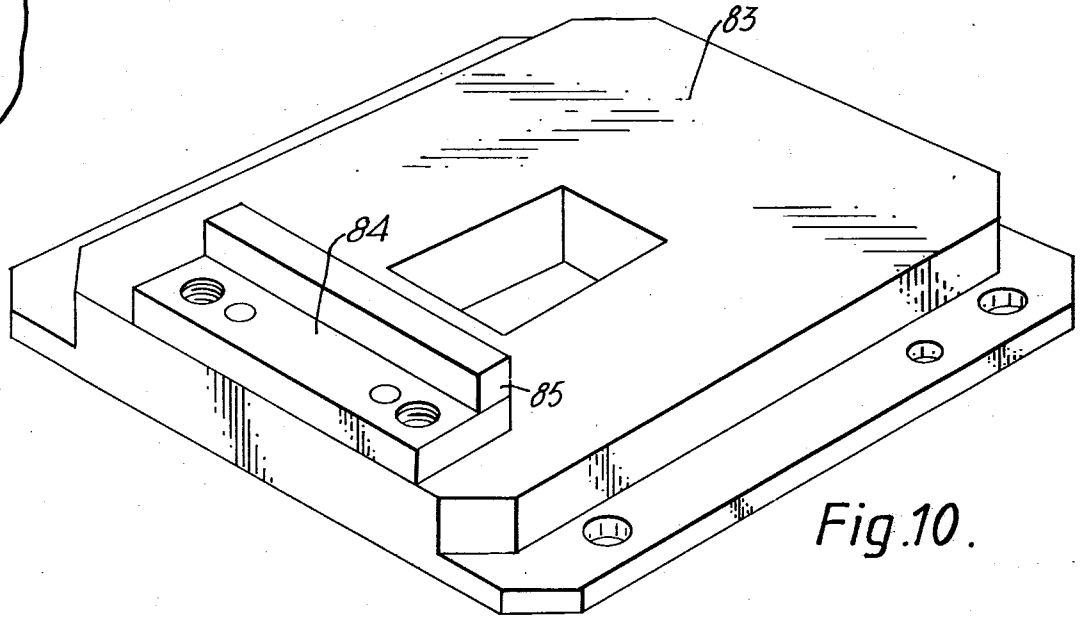
Figure 9:
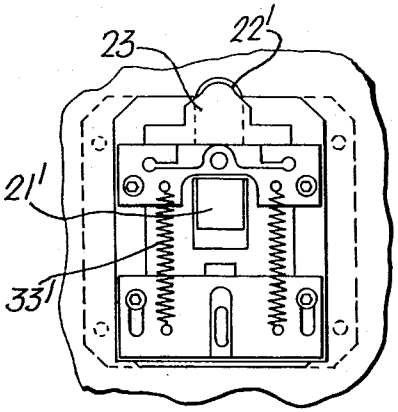

An example of the invention will now be described with reference to the accompanying drawings, in which:

FIG. 1 is a part cut away plan view of a closing machine according to the invention, FIG. 2 is a front view of the machine of FIG. 1, FIG. 3 is a cross section taken from the side at XX in FIG. 2, FIG. 4 is an enlarged plan view of the hanger pusher plate assembly a cross section of which can be seen in FIG. 3, FIG. 5 is a cross section taken on Y—Y of FIG. 4 showing details of the hanger pusher plate, FIG. 6 is a front view of a second embodiment of a closing machine according to the invention, FIG. 7 is a cross section taken from the side at ZZ in FIG. 6, FIG. 8 is a partially cut away plan of the machine of FIG. 6, FIG. 9 is a plan view of the pusher plate assembly for the machine of FIG. 6, and FIG. 10 is a perspective view of a sub-plate assembly for replacing the pusher plate assembly of FIG. 9 when carrying out a straight bind.

The closing machine shown in the drawings comprises a press means or adjustable closing bar 1 which together with an anvil 2 which is the horizontal part of an 'L' shaped angle plate 3, act to close two Wire-O binding elements 6 and 7 (partly shown in FIG. 1) at a press position 9 around to bundle of sheets 10.

A magazine 12 holds a stack 13 of horizontally stacked hanger elements which fall by gravity onto a hanger pusher plate 15, the pusher plate 15 forming translating means for translating the lowest hanger element 16 from the bottom of magazine 12 to press position 9.

The hanger pusher plate is shown in detail in FIGS. 4 and 5 and comprises a main plate 20 with a square cam receiving hole 21, a circular magnet 22, a top plate 23 which at its outer pushing edge 24 is set back from the outer edge 25 of the magnet to form a curved rebate 26 which corresponds with the curved central portion 30 (see FIG. 1) of the hanger elements. Below the main plate 20 and fixed to the main plate either side of hole 21 are lugs 32 to which are secured springs 33 which pull the plate back from the press position 9.

The adjustable closing bar 1 is adjustably mounted on closing member 36 by means of a pair of screws 38 at its front portion. Underneath the rear portion of member 36 is fixed a cam block 40 to which is fixed in turn a cam 42, the camming front face 44 of which acts through square hole 21 of the pusher plate assembly on the rear surfaces 46 and 48 of plates 20 and 23 to push the plates 20 and 23 and hence a hanger element 16 into the press position 9.

The closing member 36 is moved into the press position 9 by means of an eccentric device 50 driven by motor 52. Suitable arrangements are made to ensure that when the eccentric device 50 returns to top dead centre and member 36 returns to its uppermost position, the motor is disengaged. To achieve top dead centre a microswitch actuated by eccentric device 50 interrupts the electrical supply to a solenoid which mechanically disengages a clutch when the eccentric device reaches the top dead centre position.

In order to ensure the hanger element is placed in exactly the correct location in the press position slight horizontal adjustment can be provided between block 40 and cam 42. Also a back stop 54, the horizontal position of which can be adjusted stops plate 20 from returning too far.

Adjustment between adjustable closing bar 1 and member 36 can be indexed by an indicating plate on the front of bar 1.

The correct position of binding elements 6 and 7 in the press position is ensured by the vertical arm 62 of angle plate 3.

A thumb hole 64 in bundle of sheets 10, normally a calendar, is shown in FIG. 1. The bundle of sheets can be accurately located by means of index marks on the front of bar 1.

In operation when a footswitch (not shown) is depressed, the electric motor 52 rotates eccentric device 50 which drives member 36 and bar 1 downward and cam 42 causes the pusher plate assembly top plate 23 to push a hanger element 16 from the bottom of the magazine into the press position 9 between the Wire-O binding elements 6 and 7 into the thumb hole 64. As the bar 1 descends further the elements 6 and 7 close around lugs 66 and 67 of the hanger element either side of the curved portion 30 of the hanger element. The bundle 10 is then bound.

After the closing stroke the member 36 and bar 1 return to their upper positions and the pusher plate assembly returns to its near position and receives the next hanger element from the bottom of the magazine.

Hanger elements are fed into the magazine from a hanger storage reel 70 mounted centrally above the hanger magazine.

It will be appreciated that the machine can be used to carry out a straight bind not requiring hanger elements by detaching the wedge-shaped cam 42 so that the hanger pusher assembly cannot be pushed in the press position.

Alternatively, in order to carry out a straight bind not requiring hanger elements, a modified closing machine is provided as shown in FIGS. 6 to 10. In this machine instead of removing the cam 42, a complete hanger pusher sub-assembly 80 (comprising sub plate 81 in which is cam receiving hole 21′ and on which is mounted pusher plate 15′) is removed. The assembly 80 is removed by disconnecting the hanger supply to the hanger magazine 12′, then tilting the machine on its side, on the underside unscrewing four screws 82 and removing the assembly 80 together with magazine 12′ and replacing this with a sub plate 83 (see FIG. 10) on which is a filler block 84. The filler block has an upper portion 85 which locates just behind closing bar 1′ and prevents wire bindings from entering the gap left by removal of the hanger pusher plate 15′.

In FIG. 8 can be seen microswitch 51′ which is operated by a protrusion 53′ on eccentric device 50′ driven by motor 52′. The arrangement is the same for the embodiment shown in FIG. 3.

In FIGS. 6 and 8 can be seen adjustment side stop 90 which is controlled by knob 91 and which locates the article being bound with respect to centre line 92.

We claim:

1. A closing machine for closing wire binding elements comprising a press means and anvil for closing wire binding elements around a bundle of sheets, a magazine for storing hanger elements, and translating means for translating the hanger elements singly from the magazine to a press position between the press means and anvil.

2. A machine as claimed in claim 1 wherein the translating means is provided with a magnetised part so that the hanger element translated to the position between the press means and anvil is retained in the press position during the closing operation.

3. A machine as claimed in claim 2 wherein the magnetised part has an at least part curvilinear shape to conform with a central shaped portion on a hanger element, the magnetised part being provided on a hanger pusher plate.

4. A machine as claimed in claim 3 wherein the hanger pusher plate is moved in a generally horizontal plane into the press position by means of a camming member connected to the press means so that as the press means descends on the binding elements a hanger element is pushed from the bottom of the magazine into the press position and enters a thumb hole gap in the bundle of sheets between the binding elements.

5. A machine as claimed in claim 1 wherein the translating means is arranged to be rendered inoperative whereby straight binding without hangers is possible.

* * * * *